US005387097A

United States Patent [19]

Scheiber et al.

[11] Patent Number: 5,387,097

[45] Date of Patent: Feb. 7, 1995

[54] SELF-SEALING SPIN PACK

[75] Inventors: Herbert Scheiber, Kleinwallstadt; Wolfgang Peschke, Obernburg, both of Germany

[73] Assignee: Akzo NV, Netherlands

[21] Appl. No.: 986,298

[22] Filed: Dec. 7, 1992

[30] Foreign Application Priority Data

Dec. 6, 1991 [DE] Germany ..... 4140269

[51] Int. Cl.[6] ..... D01D 4/00

[52] U.S. Cl. ..... 425/382.2; 425/198; 425/464

[58] Field of Search ..... 425/72.2, 198, 199, 425/382.2, 461, 463, 464

[56] References Cited

U.S. PATENT DOCUMENTS

| | | | |
|---|---|---|---|
| 2,871,511 | 2/1959 | Speakman | 425/464 |
| 2,891,278 | 6/1959 | Cook | 425/464 |
| 3,028,627 | 4/1962 | McCormick | 425/199 |
| 3,050,774 | 8/1962 | Tait | 425/463 |
| 3,123,858 | 3/1964 | McDermott | 425/464 |
| 3,237,245 | 3/1966 | Nonami et al. | 425/382.2 |
| 3,353,211 | 11/1967 | Heijnis al. | 425/192 S |
| 3,360,597 | 12/1967 | Jones et al. | 425/198 |
| 3,407,437 | 10/1968 | Lenk | 425/464 |
| 3,466,703 | 9/1969 | Heckrotte | 425/199 |
| 3,480,995 | 12/1969 | Lenk | 425/464 |
| 3,500,499 | 3/1970 | Goossens | 425/198 |
| 3,553,773 | 1/1971 | Heijnis | 425/199 |
| 3,762,854 | 10/1973 | Kilsdonk | 425/382.2 |
| 4,134,954 | 1/1979 | Brauner et al. | 425/198 |
| 4,197,020 | 4/1980 | Doherty, III | 425/198 |
| 4,260,350 | 4/1981 | Russell, Jr. | 425/198 |
| 4,493,628 | 1/1985 | Lenk | 425/198 |
| 4,494,921 | 1/1985 | Sowell | 425/198 |
| 4,696,633 | 9/1987 | Lenk et al. | 425/192 S |
| 4,801,257 | 1/1989 | Lenk | 425/464 |
| 5,304,052 | 4/1994 | Schroeder et al. | 425/382.2 |

FOREIGN PATENT DOCUMENTS

| | | | |
|---|---|---|---|
| 0163248 | 12/1985 | European Pat. Off. . | |
| 10163248 | 12/1985 | European Pat. Off. . | |
| 0300120 | 1/1989 | European Pat. Off. . | |
| 20300120 | 1/1989 | European Pat. Off. . | |
| 0387470 | 9/1990 | European Pat. Off. . | |
| 0436105 | 7/1991 | European Pat. Off. . | |
| 1660209 | 2/1970 | Germany . | |
| 1529819 | 3/1970 | Germany . | |
| 2250837 | 5/1974 | Germany | 425/382.2 |
| 155090 | 5/1982 | Germany . | |
| 3915819 | 11/1990 | Germany . | |
| 47-6565 | 2/1972 | Japan | 425/382.2 |
| 2244023 | 11/1991 | United Kingdom | 425/72.2 |

*Primary Examiner*—Khanh Nguyen
*Assistant Examiner*—Joseph Leyson
*Attorney, Agent, or Firm*—Oliff & Berridge

[57] ABSTRACT

A spin pack includes a spinneret holder, a spinneret, a filter pack and an axially movable thrust piece having a central channel and seals. The seals are used according to the invention being two tubular, radially sealing elements (seal or part of a seal).

11 Claims, 7 Drawing Sheets

SELF-SEALING SPIN PACK

BACKGROUND OF THE INVENTION

The invention relates to a self-sealing spin pack for a spinner head of a spinning machine for spinning endless filaments from a viscous spinning liquid at high pressure. The invention includes a spinneret holder, in which a spinneret is inserted and is covered by a filter pack, a piston-like thrust piece, axially movable in the spinneret holder, having a central channel, the top of which borders the bottom of a distributor block which has at least one channel, a top seal between the thrust piece and the distributor block, a middle seal to seal the space above the filter pack against the spinneret holder and a bottom flat ring seal for sealing the spinneret holder at the bottom.

A self-sealing spin pack and its mode of action are disclosed by EP-A2-0 300 120 and EP-B1-0 163 248. This known spin pack can also further have a distributor plate (perforated plate) between the spinneret and the filter pack, which distributor plate has a potlike shape at the top to receive the filter pack (EP-B1-0 163 248; position 27).

This known spin pack is expensive and complicated in construction and has led in factory use to considerable problems and difficulties. As a result of the top seal, a gap is formed between the top of the thrust piece and the bottom of the distributor block. As a result of high melt pressure, high extrusion pressure and high melt temperatures, a gradual deformation and loss of the seal by flow of the sealing material into this gap occur. As a result of this, a dead space is formed, in which, because of the high residence time of the melt, polymer degradation occurs. Furthermore, leakages keep occurring at this position. The same problems, that is deformation and tearing of the seal, the formation of dead spaces (stagnant zones), polymer degradation and leakage, also occur in particular at the metal membrane seal (which is furthermore expensive to manufacture) and accordingly also at the bottom seal. This known spin pack thus has in total three seals, two of which are inadequate, of which one, the metal membrane seal, is relatively expensive. A further disadvantage arises in that as a result of the membrane seal, a relatively large free space is formed below the seal, which leads to an undesirable long residence time of the spinning liquid, in particular in the case of low filament deniers, which causes an undesired change in the same, polymer degradation and the like.

SUMMARY OF THE INVENTION

It is therefore an object of the present invention to make available a self-sealing spin pack of the generic type, which overcomes the above-mentioned disadvantages, which is in particular reliably self-sealing and thus more reliable in operation, which is simpler in construction and thus cheaper and which has a smaller free space above the filter pack. This arrangement leads to a reduction in the residence time of the spinning liquid in this region. Another object of the present invention is to be able to achieve an enlargement of the filter surface area of the filter pack even when a distributor plate (perforated plate) is used.

This object is achieved according to the invention by the self-sealing spin pack of the type described in the introduction when the top seal has a tubular shape, has an internal diameter which corresponds to the diameter of the central channel of the thrust piece and of the channel of the distributor block and extends into both channels. The top of the thrust piece lies tightly against the bottom of the distributor block under operating conditions. The thrust piece has a potlike shape at the bottom for receiving the filter pack and, possibly, a distributor plate. The middle seal likewise has a tubular shape and covers and seals the annular gap between the spinneret holder and the edge of the potlike shape of the thrust piece.

The solution principle which is the basis of the invention therefore comprises designing the thrust piece movable in the spinneret holder in such a manner that annular gaps are formed at the top between the thrust piece and the distributor block and at the bottom between the thrust piece and the spinneret holder or the distributor plate. The annular gaps first extend radially from the interior to the exterior, the width of the annular gaps (gap width) possibly changing in operation. The annular gaps are each covered with a tubular seal, so that the pressurized spinning liquid causes the seals to be pressed radially outwards onto the annular gaps and thus effect a fluid-tight seal. It must be considered surprising that, even when the annular gaps enlarge or decrease as a result of an axial movement of the piston-like thrust piece in the spinneret holder, no leakages occur, even when the pressure of the spinning liquid is increased several times and reduced again. The thrust piece, as a result, is repeatedly moved axially to and fro, generally that is up and down.

In a particularly preferred design, the middle, tubular seal is the upwards- and/or downwards-pointing side of a seal having an L-shaped cross-section (angle seal). In a further preferred design, the middle, tubular seal, that is also the angle seal, is arranged above the spinneret, the top part of the seal, or the upwards-pointing side of the angle seal, extending into the potlike shape of the thrust piece.

An essential aspect of the invention lies in the fact that the sealing action of the top and middle tubular seals or of the upwards- and/or downwards-pointing side of the angle seal, is achieved in that the seals are pressed radially outwards by the high pressure of the spinning liquid (for example 50 to 80 bar) and are thus very slightly expanded. A further essential aspect is that the membrane seal is no longer required and, if an angle seal is used, only two seals are required instead of three as before, since the upwards- and/or downwards-pointing side of the angle seal carries out the sealing function of the membrane seal. From this there results additionally the fact that the space above the filter pack can now be dimensioned considerably smaller. The advantage resulting therefrom, that is a shorter residence time for the spinning liquid, has already been previously described.

As for the rest, the self-sealing action in the spin pack according to the invention is carried out in the same manner as in the known spin pack. Also in this case, with a pressure build-up in the space above the filter pack, a movement, although here slight, of the thrust piece takes place within the spinneret holder upwards by only a few tenths of a millimeter, until the top of the thrust piece lies tightly against the bottom of the distributor block. The pressure acts downwards in such a manner that the filter pack and—if present—the distributor plate (perforated plate) or the spinneret is pressed onto the bottom flat ring seal, which, if an angle seal is used, is formed by the radially inwards-pointing side of the angle seal.

In an embodiment of the invention, the optionally usable perforated plate does not have a pot shape at the top, but is also flat on the top. This leads to a significant enlargement of the filter surface area of the filter pack, which for example, can be approximately 25%, since in this case the external diameter of the filter pack corresponds to the internal diameter of the spinneret holder in the bottom region.

The filter pack can be equipped with the conventional media corresponding to the state of the art such as screens having differing mesh sizes, filter granules, for example sand, having different particle sizes, discs of sintered materials, etc. When loose filter granules are used, the distributor plate is expediently furnished on the top with a narrow border, the height of which corresponds to the bed height of the filter granule layer. Its design with respect to construction, height, selection of filter media, etc. depends on the type of the viscous spinning liquid, which can be the melt of thermoplastic polymers such as polyester, polyamide, etc., a solution, such as polyacrylonitrile in DMF solution, and others.

A material for the seals which has proved itself optimal is in particular soft aluminum, but soft iron and other easily deformable materials are also suitable. Suitable materials are those which can endure for long periods even the possibly high temperatures of the spinning liquid, which in the case of polymer melts can be, for example, up to 450° C.

The central channel in the thrust piece can have the same diameter or cross-section over its entire length, but can also have a diameter or cross-section increasing or decreasing in the direction of flow, that is a conical shape. In particular, a mixing element, preferably a so-called static mixer, can be arranged in the channel of the thrust piece.

The attachment of the spinneret holder to the distributor block can be carried out by conventional means such as screws or by other means. The joining known per se with the aid of a multistart thread has proved to be particularly advantageous. The thread is arranged on the outer periphery of the bottom part of the distributor block and, as a companion piece interacting therewith, on the inner periphery of the top part of the spinneret holder. It is possible here to achieve a sufficiently enduring attachment of the spinneret holder even with a rotation of the latter of only 180° or at the most 360°. It is important in this case to dimension the pitch of the thread to be so low that self-locking of this screw joint is achieved. Otherwise, another safeguard against unscrewing is to be provided, for example a retaining pin.

The shape and dimensions of the spin pack and its components are not subject to any restrictions—neither upwards nor downwards—and are matched to the particular requirements.

A further essential advantage in the spin pack according to the invention lies in the fact that its self-sealing action occurs reliably every time even after a repeated complete—intended or unintended—loss of pressure or pressure decrease.

BRIEF DESCRIPTION OF THE DRAWINGS

The invention is described in more detail below with reference to the drawings. In partly simplified representation.

DETAILED DESCRIPTION OF PREFERRED EMBODIMENTS

Figure 1:
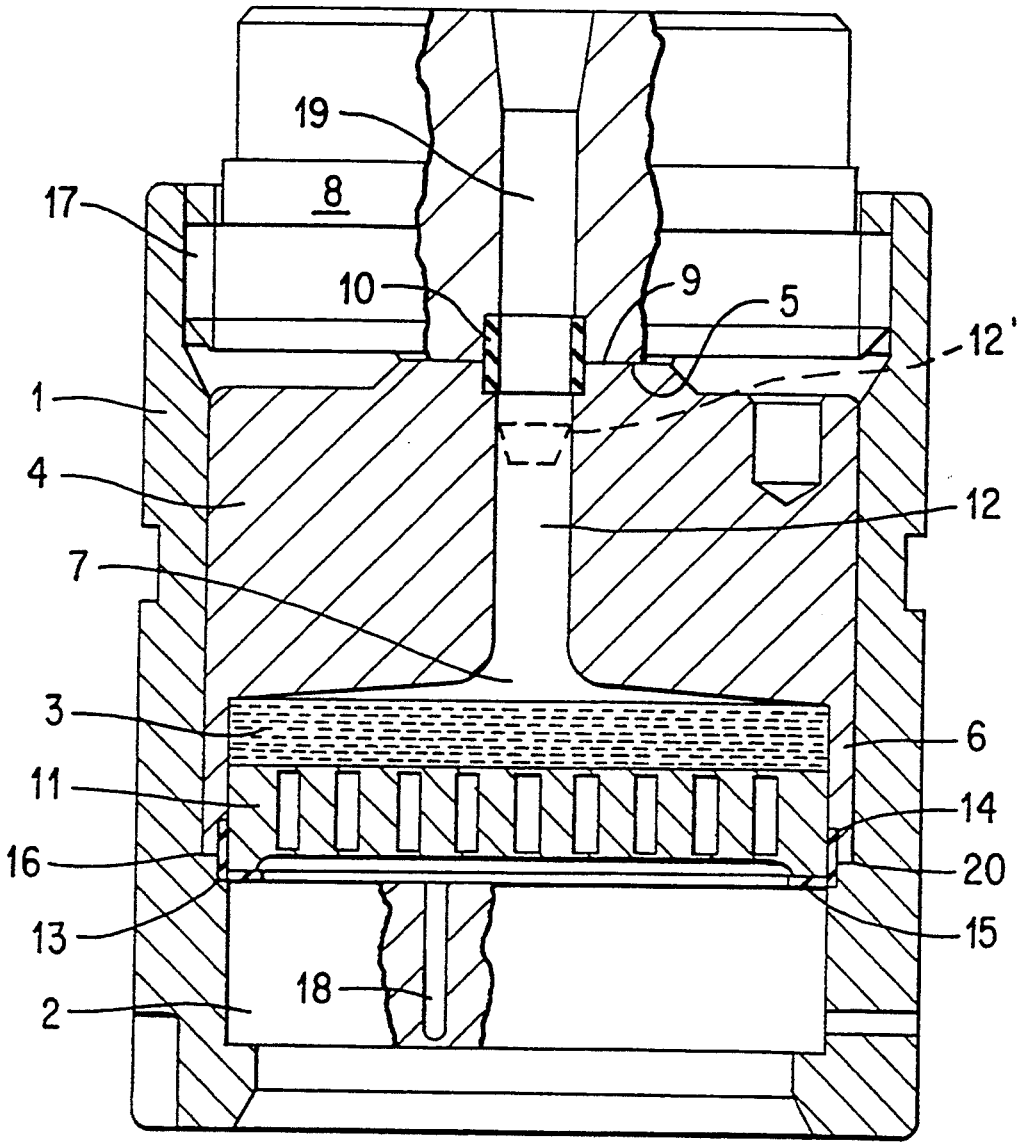
FIG. 1 shows a particularly preferred embodiment of the spin pack in longitudinal profile.

In FIG. 1, the following parts are depicted, the arrangement, function and mode of action of which have already been described in detail: spinneret holder 1, which is attached with the aid of the two- three- or four-start thread 17 to the lower end of distributor block 8, arranged therein spinneret 2 having spinneret holes 18, distributor plate 11 designed as a perforated plate, angle seal 13 having axially upwards-pointing side 14 and radially inward-pointing side 15, filter pack 3, space 7 above filter pack 3, thrust piece 4 having central channel 12 and potlike shape 6 in the lower part of thrust piece 4 for receiving filter pack 3 and perforated plate 11, which projects above rim 20 of potlike shape 6, annular gap 16 between rim 20 and the shoulder of spinneret holder 1 at this point, which annular gap is covered and sealed by side 14 of angle seal 13, top 5 of thrust piece 4, which lies tightly against bottom 9 of distributor block 8, without leaving a gap, top seal 10 which covers and seals the joint between surfaces 5 and 9 and projects into channel 12 of thrust piece 4 and channel 19 of distributor block 8. The potlike shape 6 of the thrust piece 4 is engageable with the shoulder of the spinneret holder to limit movement of the thrust piece within the holder. The internal diameter of top seal 10 is equal to the diameter of channels 12 and 19, so that in this manner a smooth feed without projections is formed for the spinning liquid. Side 14 of seal 13 seals space 7 above filter pack 3 against the gap between thrust piece 4 and spinneret holder 1, in order to prevent penetration of spinning liquid into this gap. It exercises in this case, in an essentially simpler and reliable manner, the same function as did previously the expensive and fault-susceptible membrane seal of the prior art. Side 14 of seal 13 is—considered alone—of tubular design, side 15 has—considered alone—the shape of a flat seal (flat gasket). Side 14 seals in a radial direction under pressure (radial pressure component). As shown in FIG. 1, side 14 of seal 13 is disposed partially inside a bottom portion of potlike space 6 and partially inside spinneret holder 1. Also as illustrated in FIG. 1, angle seal 13 is preferably L-shaped. Instead of perforated plate 11, as depicted in FIG. 1,, spinneret 2 can alternatively be disposed at this point. At the inner surface of spinneret holder 1, a corresponding projecting support surface for supporting spinneret 2 is to be provided.

In an alternate embodiment, a mixing element 12' (shown in phantom in FIG. 1) is disposed in the channel 12 of the thrust piece 4. The mixing element 12' is preferably a static mixer.

Figure 2:
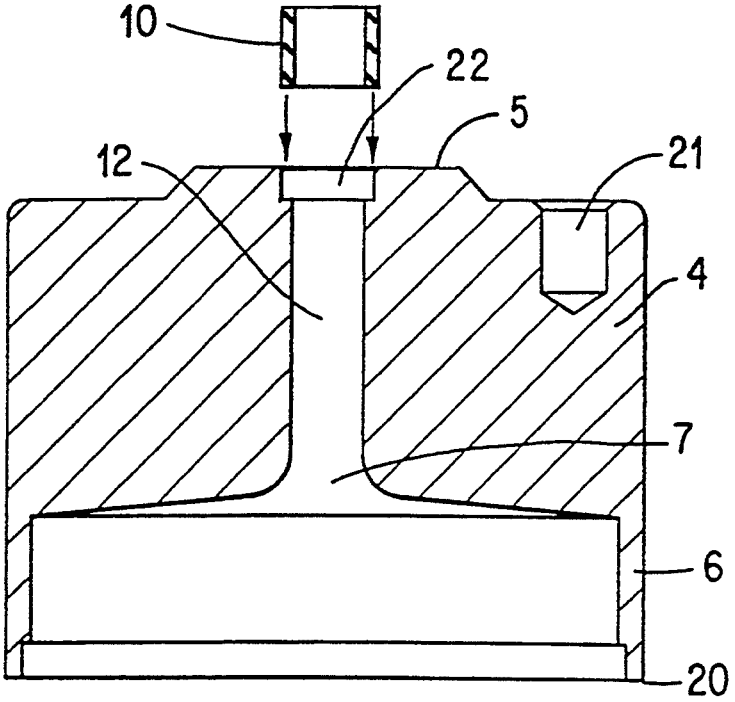
FIG. 2 shows an embodiment of the thrust piece in longitudinal profile.

FIG. 2 depicts an embodiment of thrust piece 4. The parts 5–7, 12 and 20, which have already been described above for FIG. 1, will not be enumerated and described again here. Reference numeral 21 depicts one of for example three holes, which facilitate fixing thrust piece 4 during the inserting of filter pack 3 and, possibly, distributor plate 11 by a corresponding number of pins arranged on a support. For this purpose, thrust piece 4 is arranged with surface 5 at the top. Channel 12 has in its top end section enlargement 22 to receive the bottom part of seal 10.

Figure 3:
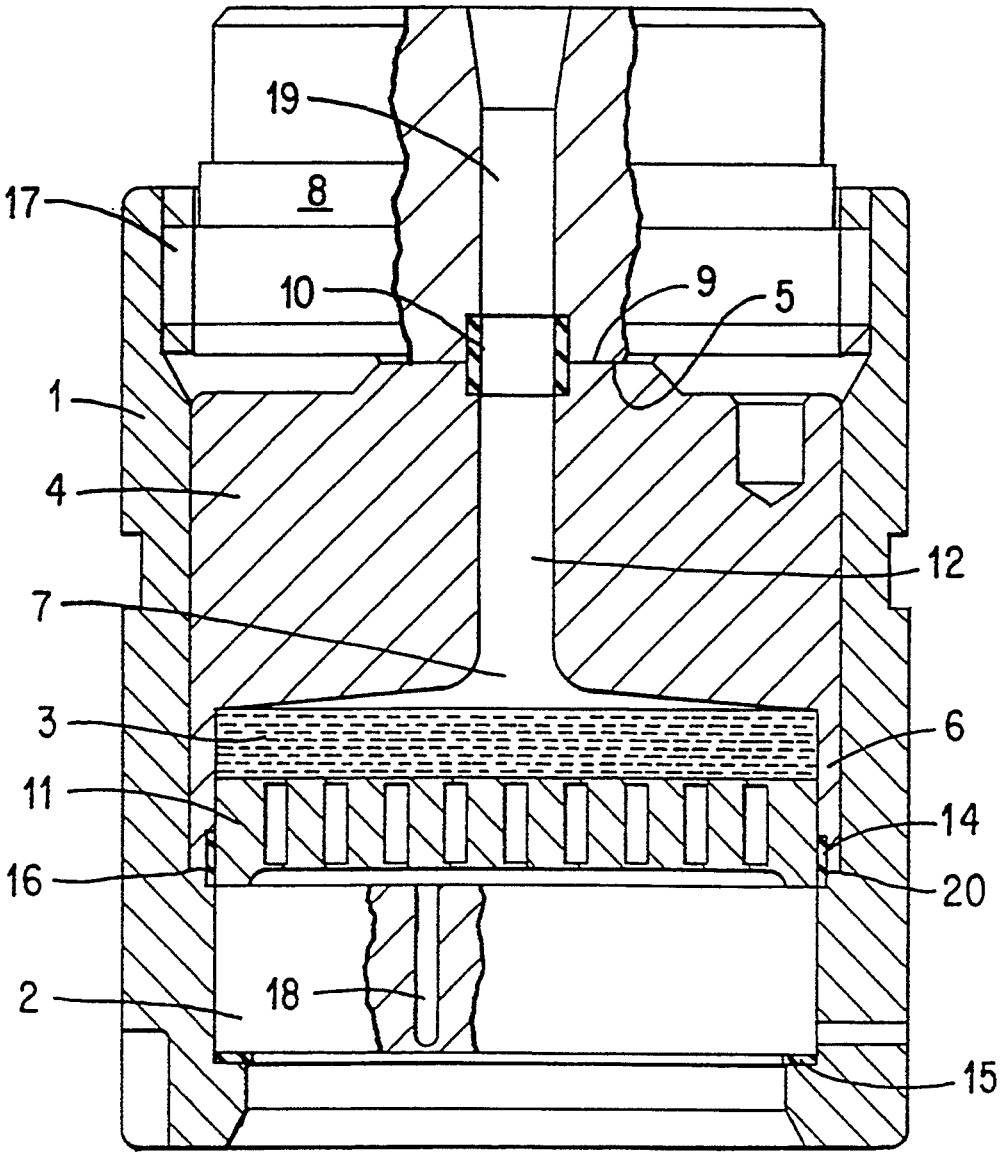
FIGS. 3–7 show further embodiments of the spin pack in longitudinal profile.

The embodiment depicted in FIG. 3 differs from the embodiment depicted in FIG. 1 only in that the middle, tubular seal 14 and the bottom, flat seal 15 are not parts of an angle seal. The bottom, flat seal 15 here is arranged beneath spinneret 2. Since all remaining parts are identical to those parts depicted in FIG. 1, continued description of this embodiment is dispensed with.

Figure 4:
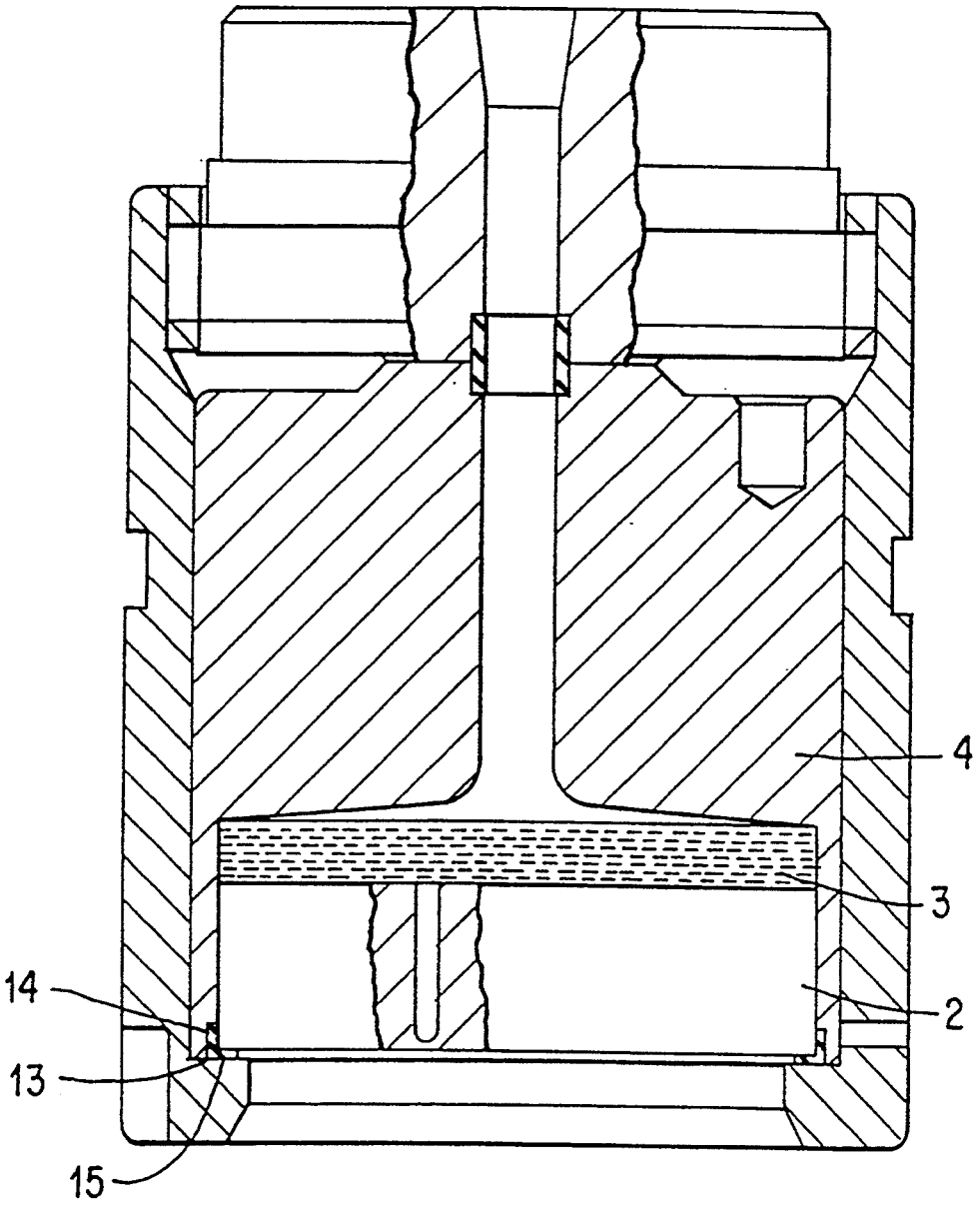
Figure 5:
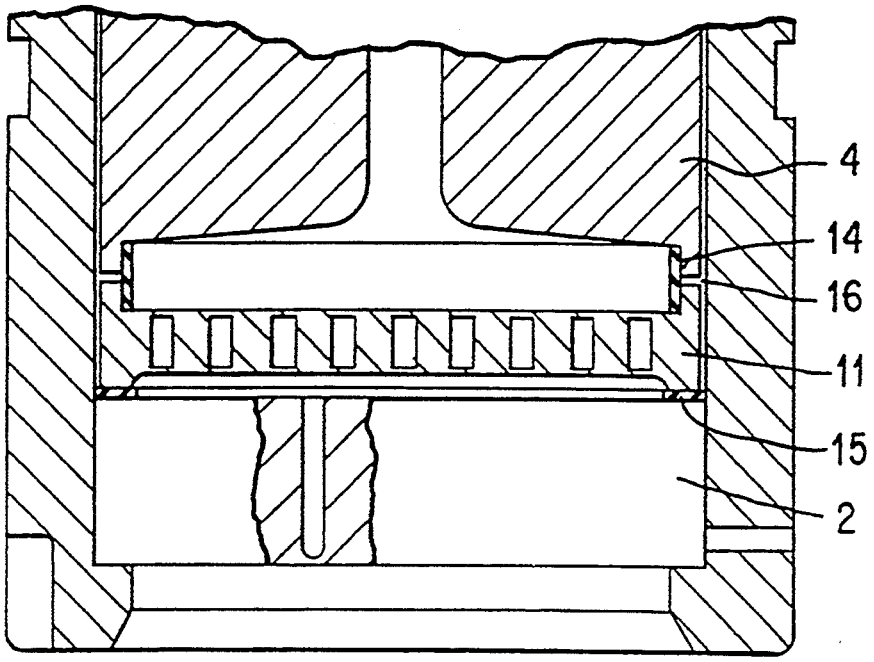
Figure 6:
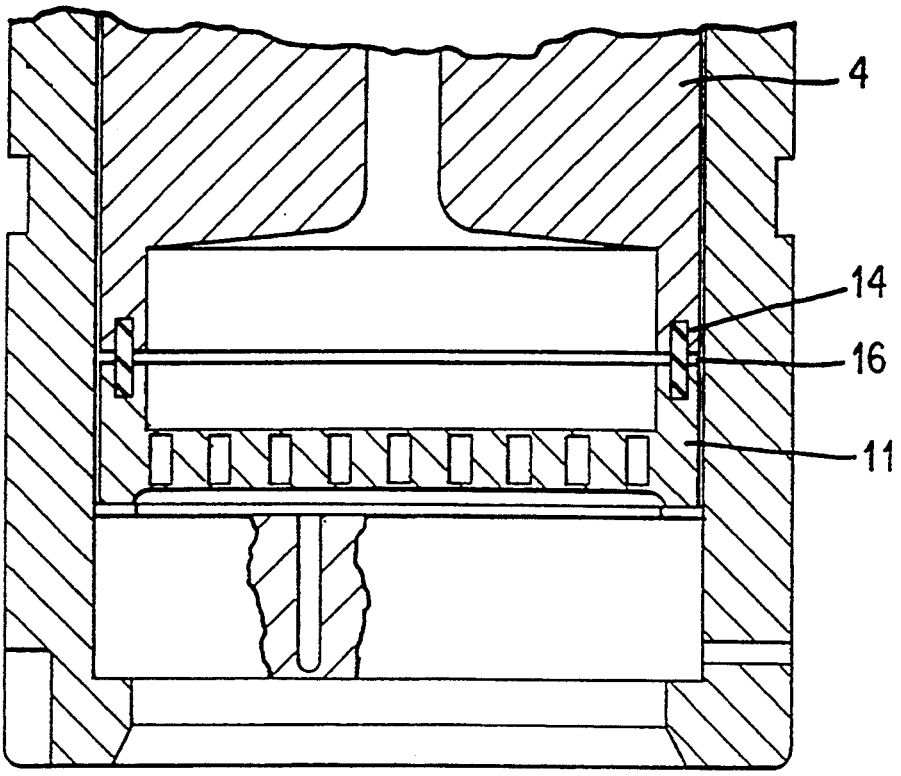
Figure 7:
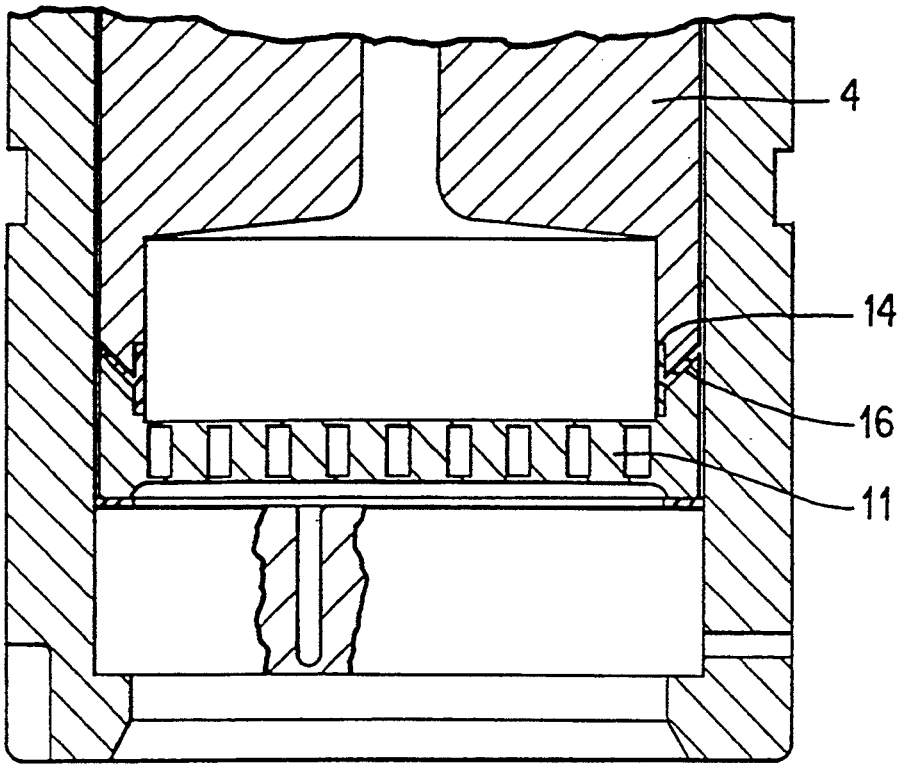

The embodiments depicted in FIGS. 4 to 7 differ essentially only in the design of thrust piece 4 and, when this is present, perforated plate 11 and in the design and arrangement of seals 14 and 15. All remaining parts are therefore only furnished with reference numbers if they are mentioned in the description below. In FIGS. 5 and 7 furthermore, the top parts and the filter pack are left out. Continued description of these figures below is superfluous with regard to the description of FIGS. 1 to 3.

FIG. 4 depicts an embodiment in which no distributor plate 11 is used, so that filter pack 3 lies directly on spinneret 2. Middle, tubular seal 14 and bottom, flat seal 15 here are again formed by the sides of an angle seal 13. In this embodiment, this is arranged beneath spinneret 2.

In the embodiment depicted in FIG. 5, middle, tubular seal 14 is arranged above distributor plate 11, and bottom, flat seal 15 is arranged between distributor plate 11 and spinneret 2. Distributor plate 11 here is not flat on the top, but designed in the shape of a pot—for example to receive filter granules such as sand or the like. Middle, tubular seal 14 projects into the potlike part of distributor plate 11 and of thrust piece 4 and lies against the inner surface of the "pot" rim. Annular gap 16 is clearly to be seen between the bottom rim of the potlike shape of thrust piece 4 and the top rim of the potlike shape of distributor plate 11, which annular gap is covered by middle, tubular seal 14, even if it should be enlarged by the movement of thrust piece 4 upwards, for example to double the width.

The embodiment depicted in FIG. 6 corresponds essentially to that depicted in FIG. 5, middle, tubular seal 14 being arranged here however in an annular groove arranged both at the bottom end of the potlike shape of thrust piece 4 and at the top end of the potlike shape of distributor plate 11.

The embodiment depicted in FIG. 7 corresponds essentially to that depicted in FIG. 5. However, in this embodiment, radially outward-leading annular gap 16 covered by middle, tubular seal 14 does not run horizontally as in the embodiments described above, but upwardly at an incline. It could equally well run downwards at an incline. The sealing action is not impaired as a result.

Although the invention has been described in detail, it will be apparent to those skilled in the art that various modifications may be made without departing from the scope of the invention, which is defined in the following claims.

What is claimed is:

1. A self-sealing spin pack for a spinner head of a spinning machine for spinning endless filaments from a viscous spinning liquid at high pressure, comprising:

a spinneret holder having a spinneret inserted in a holder bottom portion of said spinneret holder, said spinneret being covered by a filter pack;

a thrust piece, axially movable in the spinneret holder, said thrust piece having a central channel extending from a top portion of said thrust piece toward a thrust piece bottom portion of said thrust piece, said top portion of the thrust piece bordering a block bottom portion of a distributor block, said distributor block having a channel therein communicating with said central channel;

a top seal between the thrust piece and the distributor block;

a middle seal to seal the filter pack against the spinneret holder; and a bottom flat ring seal disposed directly above said spinneret and between said spinneret and said filter pack for sealing said holder bottom portion of the spinneret holder, wherein the top seal has a tubular shape and an internal diameter which corresponds to a diameter of the central channel of the thrust piece and of the channel of the distributor block, said top seal extending into both of said channels, the top portion of the thrust piece being disposed tightly against the block bottom portion of the distributor block under operating conditions, wherein the thrust piece has a potlike shape at said thrust piece bottom portion for receiving the filter pack, said potlike shape engageable with a shoulder of the holder to limit movement of the thrust piece within the holder, said potlike shape disposed radially between said filter pack and said spinneret holder, the middle seal being disposed partially inside a bottom portion of said potlike shape and partially inside the spinneret holder and having a tubular shape, said middle seal covering and sealing an annular gap between the shoulder of the spinneret holder and the potlike shape of the thrust piece.

2. A spin pack according to claim 1, wherein the middle, tubular seal and the bottom flat ring seal together form a seal having an L-shaped cross-section, the middle seal being an upwards-pointing side of the L-shaped cross-section.

3. A spin pack according to claim 1, further comprising a distributor plate having a flat top surface and arranged above and adjacent the spinneret and below and adjacent the filter pack in said potlike shape of said thrust piece, wherein the middle seal extends partially in said distributor plate and the bottom flat ring seal is disposed between the distributor plate and the spinneret.

4. A spin pack according to claim 1, wherein a mixing element is disposed in the channel ok the thrust piece.

5. A spin pack according to claim 2, further comprising a distributor plate having a flat top surface and arranged above the spinneret and below the filter pack, said bottom seal being disposed between the distributor plate and the spinneret.

6. A spin pack according to claim 2, wherein a mixing element is disposed in the channel of the thrust piece.

7. A spin pack according to claim 3, wherein a mixing element is disposed in the channel of the thrust piece.

8. A self-sealing spin pack for a spinner head of a spinning machine for spinning endless filaments from a viscous spinning liquid at high pressure, comprising:

a spinneret holder having a spinneret inserted in a holder bottom portion of said spinneret holder, said spinneret being covered by a filter pack;

a thrust piece, axially movable in the spinneret holder, said thrust piece having a central channel extending from a top portion of said thrust piece toward a thrust piece bottom portion of said thrust piece, said top portion of the thrust piece bordering a block bottom portion of a distributor block, said distributor block having a channel therein communicating with said central channel;

a top seal between the thrust piece and the distributor block;

a middle seal to seal the filter pack against the spinneret holder; and a bottom flat ring seal disposed directly beneath said spinneret and between said spinneret and a protruding shoulder of said holder bottom portion of said spinneret holder, wherein the top seal has a tubular shape and an internal diameter which corresponds to a diameter of the central channel of the thrust piece and of the channel of the distributor block, said top seal extending into both of said channels, the top portion of the thrust piece being disposed tightly against the block bottom portion of the distributor block under operating conditions, wherein the thrust piece has a potlike shape at said thrust piece bottom portion for receiving the filter pack, said potlike shape engageable with a shoulder of the holder to limit movement of the thrust piece within the holder, said potlike shape disposed radially between said filter pack and said spinneret holder, the middle seal being disposed partially inside a bottom portion of said potlike shape and partially inside the spinneret holder and having a tubular shape, said middle seal covering and sealing an annular gap between the shoulder of the spinneret holder and the potlike shape of the thrust piece.

9. A spin pack according to claim 8, wherein a mixing element is disposed in the channel of the thrust piece.

10. A spin pack according to claim 8, further comprising a distributor plate having a flat top surface and arranged above and adjacent the spinneret and below and adjacent the filter pack in said potlike shape of said thrust piece.

11. A spin pack according to claim 10, wherein a mixing element is disposed in the channel of the thrust piece.

* * * * *

UNITED STATES PATENT AND TRADEMARK OFFICE

CERTIFICATE OF CORRECTION

PATENT NO. : 5,387,097

DATED : February 7, 1995

INVENTOR(S) : Herbert Scheiber et al

It is certified that error appears in the above-indentified patent and that said Letters Patent is hereby corrected as shown below:

Column 6, lien 47, change "ok" to --of --.

Signed and Sealed this

Twenty-fifth Day of April, 1995

*Attest:*

Bruce Lehman

BRUCE LEHMAN

*Attesting Officer*

*Commissioner of Patents and Trademarks*